US008763965B1

(12) United States Patent
Peay

(10) Patent No.: US 8,763,965 B1
(45) Date of Patent: Jul. 1, 2014

(54) DISHWASHER ANCHORING BRACKET

(76) Inventor: Michael Peay, Brentwood, TN (US)

( * ) Notice: Subject to any disclaimer, the term of this patent is extended or adjusted under 35 U.S.C. 154(b) by 0 days.

(21) Appl. No.: 12/547,652

(22) Filed: Aug. 26, 2009

Related U.S. Application Data

(63) Continuation-in-part of application No. 12/108,811, filed on Apr. 24, 2008, now abandoned.

(51) Int. Cl.
*A47B 96/06* (2006.01)

(52) U.S. Cl.
USPC ..... 248/205.1; 248/300; 312/228; 4/636

(58) Field of Classification Search
USPC ..... 248/201, 205.1, 300, 906, 909; 312/140.1, 228, 311; 52/714, 746.1
See application file for complete search history.

(56) References Cited

U.S. PATENT DOCUMENTS

| | | | | | |
|---|---|---|---|---|---|
| 2,549,415 | A * | 4/1951 | Bonnell | 4/636 |
| 2,881,924 | A * | 4/1959 | Kruse et al. | 211/26 |
| 3,982,287 | A * | 9/1976 | Miller | 4/636 |
| 4,940,298 | A * | 7/1990 | Jackson et al. | 312/228 |
| 5,209,444 | A * | 5/1993 | Rinderer | 248/205.1 |
| 5,386,959 | A * | 2/1995 | Laughlin et al. | 248/205.1 |
| 5,405,111 | A * | 4/1995 | Medlin, Jr. | 248/205.1 |
| 5,538,206 | A * | 7/1996 | Sather | 248/27.1 |
| 5,653,550 | A * | 8/1997 | Mutz et al. | 403/329 |
| 5,860,436 | A * | 1/1999 | Hobday | 134/58 D |
| 5,938,157 | A * | 8/1999 | Reiker | 248/200.1 |
| 6,283,668 | B1 * | 9/2001 | Norek | 403/231 |
| 6,484,979 | B1 * | 11/2002 | Medlin, Jr. | 248/205.1 |
| 6,484,980 | B2 * | 11/2002 | Medlin et al. | 248/205.1 |
| 6,519,791 | B2 * | 2/2003 | Randolph | 4/695 |
| 7,198,242 | B1 * | 4/2007 | Bently | 248/300 |
| 7,271,336 | B2 * | 9/2007 | Dinh | 174/58 |
| 7,429,021 | B2 * | 9/2008 | Sather et al. | 248/201 |
| 7,521,631 | B2 * | 4/2009 | Dinh | 174/58 |
| 7,591,385 | B2 * | 9/2009 | Brooks | 211/94.01 |
| 2004/0056168 | A1 * | 3/2004 | Johnson | 248/475.1 |
| 2007/0151019 | A1 * | 7/2007 | Marr et al. | 4/633 |
| 2008/0272267 | A1 * | 11/2008 | Kristensson et al. | 248/675 |
| 2009/0131919 | A1 * | 5/2009 | Davey | 604/891.1 |

* cited by examiner

*Primary Examiner* — Terrell McKinnon
*Assistant Examiner* — Daniel Breslin
(74) *Attorney, Agent, or Firm* — Ryan D. Levy; Waddey & Patterson, P.C.

(57) ABSTRACT

An anchoring bracket for a dishwasher including a bracket body having a length, width and thickness, two ends and at least one anchoring zone with the at least one anchoring zone for corresponding to the attachment of the dishwasher anchoring hardware and a plurality of anchoring holes within the at least one anchoring zone for providing multiple options in anchoring a dishwasher.

16 Claims, 15 Drawing Sheets

DISHWASHER ANCHORING BRACKET

The present application is a continuation-in-part of copending and commonly assigned U.S. patent application Ser. No. 12/108,811, entitled "Dishwasher Anchoring Bracket" and filed on Apr. 24, 2008 the disclosure of which is incorporated herein by reference.

The present invention relates to a dishwasher anchoring bracket and a method for anchoring a dishwasher, the dishwasher being mounted between two cabinets or structural areas. In optional embodiments, the anchoring bracket may be attached to the top edges of adjacent cabinets or alternatively may be attached to the side walls of adjacent cabinets for anchoring a dishwasher.

In the field of home design there are a multitude of different countertops that may be utilized within a kitchen. Oftentimes these types of countertops may include natural stone such as granite, limestone, marble, gabbro and soapstone as well as other solid type materials such as stainless steel, copper or synthetic countertop materials. With the popularity of these type materials utilized within home designs today, various anchoring methods have developed for installing a dishwasher within a kitchen. Current anchoring devices are generally glued in place to a granite countertop or the like with a type of epoxy or adhesive with the dishwasher properly placed for alignment purposes.

Other ways in which home builders may anchor a dishwasher is in creating a recess in the underside of a granite countertop with a wood block epoxied into the recess so that the dishwasher brackets can be installed. Generally when using this style of anchoring the dishwasher must also be on site so that proper measurements can be taken for the bracket.

If the dishwasher is not on site with the associated anchoring hardware utilized in anchoring a dishwasher, the installer must make an additional trip in order to properly place the anchoring device. Additional steps are also required as a plumber must remove the dishwasher which was placed for sizing reasons and possibly also remove anchoring hardware from the bracket and pull the dishwasher out to connect the lines in completing the plumbing requirements for the kitchen. Subsequently the dishwasher must then be reanchored after the plumbing steps have been completed.

Other solutions have included side mounting a dishwasher to cabinets without securing the dishwasher to the countertop. In side mounting a dishwasher to cabinets, special clips or modification of the dishwasher anchoring hardware must be utilized in order to adequately secure the dishwasher in place. In some instances a dishwasher may tilt when the door is opened due to an incorrect installation where the dishwasher is attached to the cabinet with two screws or where a bracket has broken and the dishwasher is not adequately secured to the cabinet.

An optional object of the present invention is to provide a dishwasher anchoring bracket for anchoring a dishwasher within a kitchen. Optionally, the anchoring bracket may provide a user with a multiplicity of anchoring options so that an individual would not require the dishwasher to be present during completion of a kitchen.

Another optional object of the invention is to provide an anchoring bracket for a dishwasher which is secured to adjacent structural elements.

Yet another optional object of the invention is to provide a dishwasher anchoring bracket for anchoring a dishwasher, the bracket having a generally universal characteristic. "Universal" as used herein is defined as being applicable to about most dishwasher designs commonly used in a residential kitchen.

Yet another optional object of the invention is to provide an anchoring bracket for anchoring a dishwasher that is economical to produce and that is simple and reliable to use.

Still another optional object of the invention is a method of anchoring a dishwasher comprising the use of an anchoring bracket attachable to adjacent structures which provides for a plurality of options in securing the dishwasher to the bracket.

In accordance with the purpose of the invention, as embodied and broadly described herein, the invention includes an anchoring bracket for a dishwasher which may be utilized within a residential kitchen or the like. The anchoring bracket may include one or more anchoring zones for corresponding to the attachment of the dishwasher anchoring hardware. Additionally, the anchoring bracket may also include structural attachment points at each end of the bracket so that the bracket may be attached to adjacent cabinetry or structures and thus preclude the necessity of drilling into the above countertop. The anchoring bracket may also include a caulk area for applying caulk or adhesive in providing either greater securement or greater shock absorption to the bracket for when the countertop is placed. Furthermore, the anchoring bracket may include flexible characteristics so that the ends may be bent in attaching the bracket to the side of the cabinet or adjacent structure rather than the top surface. The structural attachment points may include multiple holes, recesses, ridges or the like so that the anchor bracket may be securely fastened to cabinetry or third structural elements. Within the anchoring zone is a plurality of interconnected holes to provide a user with multiple options in anchoring a dishwasher as different dishwashers may line up within the specified area differently.

As used herein the term "engage" means to interact with, interlock with, associate with or communicate with.

Further as used herein, the term "caulk" is used to mean caulk, epoxy, adhesive, sealant or filler.

According to another optional aspect of the invention, a method for anchoring a dishwasher is disclosed which includes a step of providing an area specific for a dishwasher to fit between two structures which may include two cabinets, providing the anchoring bracket as described herein, attaching the anchoring bracket at each adjacent cabinet at the structural attachment points of the bracket and subsequently attaching the dishwasher and anchoring hardware to the anchoring bracket through at least one of the anchoring holes of an anchoring zone. The method may also include embodiments where caulk is utilized within a caulk area and further improving the use of the anchoring bracket with a dishwasher underneath a countertop. In further optional embodiments, multiple anchoring zones as well as multiple caulk areas may be provided for the anchoring bracket.

Thus, where the anchoring bracket of an optional embodiment of the invention is utilized, a dishwasher is not required to be on site for alignment for proper installation. As such, a quicker installation time may occur as an individual would not have to install the dishwasher and subsequently remove it for plumbing and other work or have the potential of damaging a countertop by drilling or other actions.

Yet another optional aspect of the invention may include the use of the flexible ends to provide securement of the anchoring bracket to the sides of adjacent cabinets.

An additional optional aspect of the invention may include two anchoring zones about a caulk area for providing an arrangement useful for anchoring a variety of different dishwashers.

Another optional aspect of the invention may include a caulk area/anchoring zone/caulk area/anchoring zone/caulk area arrangement for providing two anchoring zones and three caulk areas.

An additional optional aspect of the invention includes an anchoring bracket wherein the countertops which may be above the dishwasher include a type of material wherein drilling, etching, screwing or attaching other materials thereto may be undesirable. For example, many of the natural stones including granite, limestone, marble, soapstone and gabbro require skill to drill into as a user risks cracking or undesirably deforming a countertop surface. Other countertop surfaces include stainless steel, glass as well as many of the synthetic countertop materials which are comprised of materials in which one would rather not drill or grind into for anchoring a dishwasher. Such drilling or grinding may result in cracking or other nondesirable changes to the countertop.

Another optional aspect of the invention may include the use of caulk with the anchoring bracket which may provide for a further shock absorbing and stabilizing quality.

The anchoring bracket and method of anchoring the anchoring bracket may preclude the necessity of having a dishwasher on site for alignment purposes as is typically required of the prior art. Additionally, a dishwasher would not have to be installed and then removed for completion of the plumbing as the anchoring bracket provides for multiple options in anchoring a dishwasher.

Yet another aspect of the invention may include the use of screws, nails or other elements for attaching the anchoring bracket to adjacent structures.

The term "providing", and forms thereof, are used in a broad sense, and are referred to, but are not limited to, making available for use, enabling usage, giving, supplying, obtaining, getting hold of, acquiring, making ready for use, and/or placing into position ready for use.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate optional embodiments of the invention and together with the description serve to explain some principles of the invention.

FIG. 1 comprises a perspective view of an optional embodiment of a dishwasher anchoring bracket.

Reference will now be made in detail to optional embodiments of the invention, examples of which are illustrated in accompanying drawings. Whenever possible, the same reference numbers are used in the drawing and in the description referring to the same or like parts.

Figure 1:
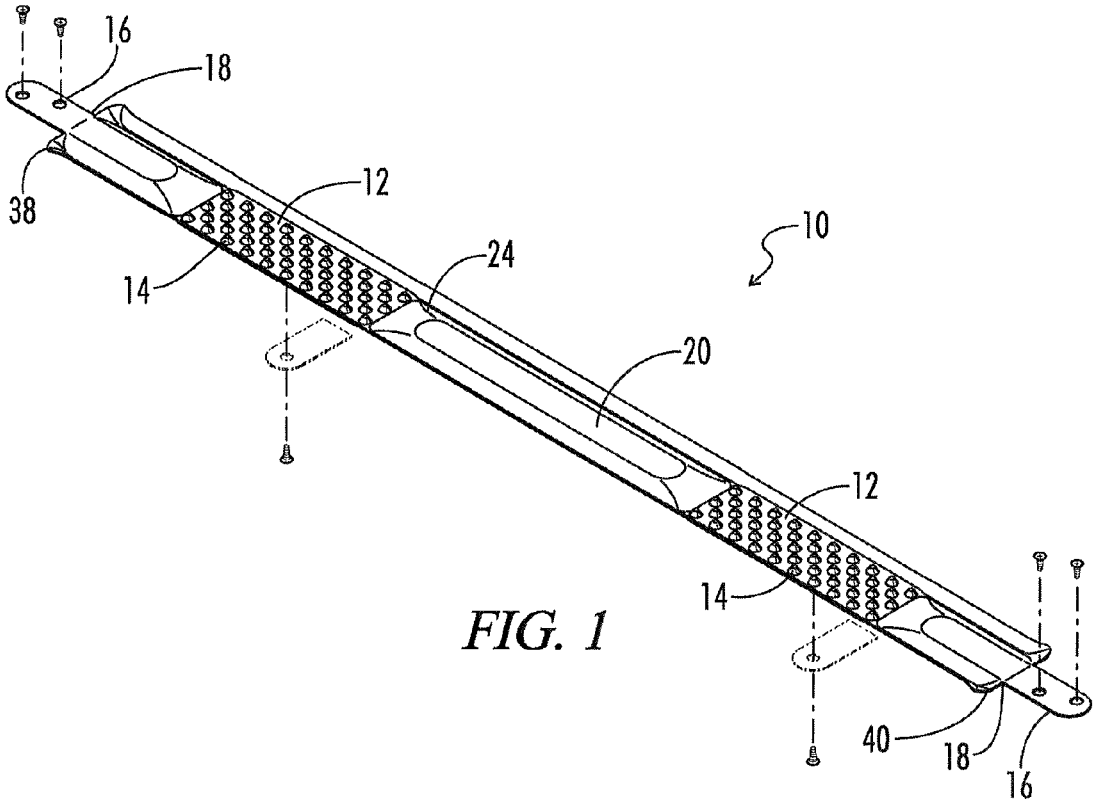
Figure 2:
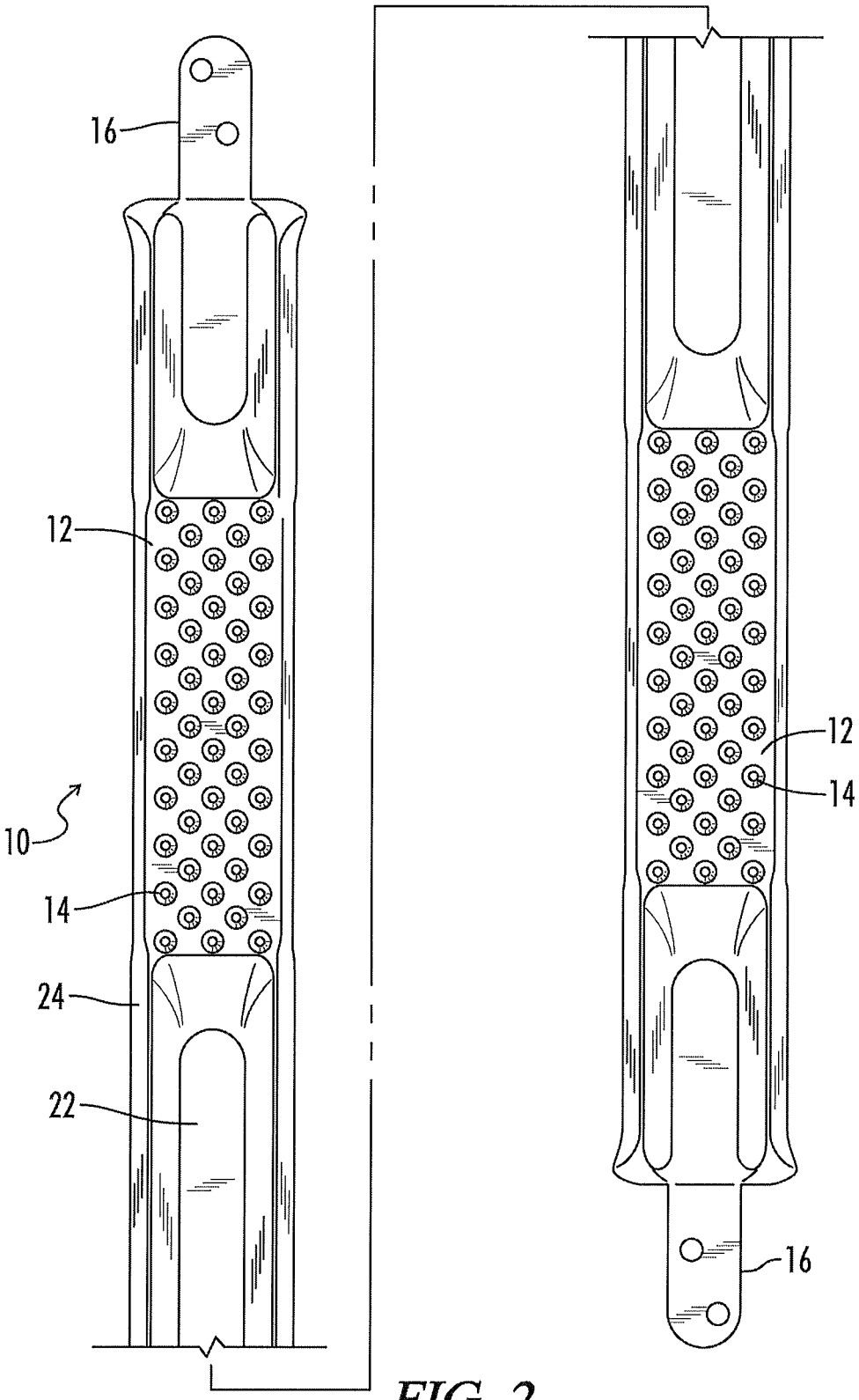
FIG. 2 is a top view of an optional embodiment of a dishwasher anchoring bracket.
Figure 3:
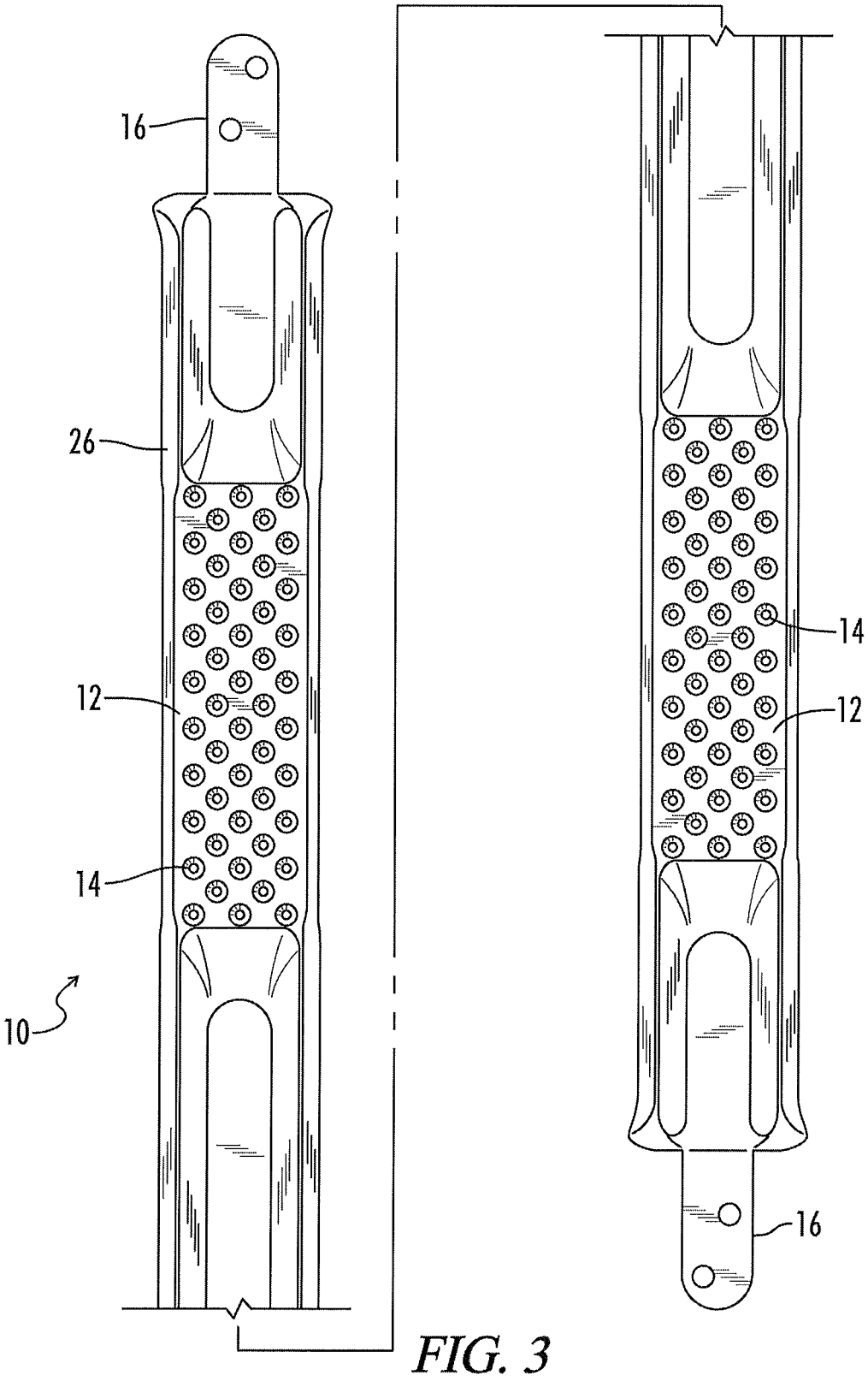
FIG. 3 is a bottom view of an optional embodiment of the dishwasher anchoring bracket.

As shown in FIGS. 1-8 there are multiple optional embodiments of dishwasher anchoring bracket 10. Generally dishwasher anchoring bracket 10 comprises at least one anchoring zone 12 and two structural attachment points.

Anchoring zone 12 may comprise a plurality of anchoring holes within anchoring zone 12 which provides for multiple choices for a user in securing a dishwasher. By having a plurality of anchoring holes 14 spaced about anchoring zone 12 a user does not have to specifically mark the location where the dishwasher hardware used for anchoring will be located. As previously mentioned, this provides a generally universal characteristic to the anchoring bracket. More specifically, the plurality of holes allow one to simply install dishwasher anchoring bracket 10 and provide the user with the option of attaching the dishwasher via the dishwasher anchoring hardware to the anchoring hole or holes 14 which align with the hardware. As used herein "dishwasher anchoring hardware" is defined to mean any type of L-shaped attachment, strap, clip or the like which is attached to the top surface of a dishwasher and again connect with dishwasher anchoring bracket 10. In further optional embodiments lesser or greater numbers of anchoring holes 14 may be included with the holes possibly being of different sizes or shapes with the provided embodiments not taken as limiting in this regard. Generally, the plurality of anchoring holes within the anchoring zone provide for multiple anchoring locations for a dishwasher.

Dishwasher anchoring bracket 10 of the present invention includes top surface 24 and bottom surface 26 where top surface 24 is the surface facing upwards that is in contact with the countertop with bottom surface 26 being the side of dishwasher anchoring bracket 10 that is facing the dishwasher.

Figure 4:
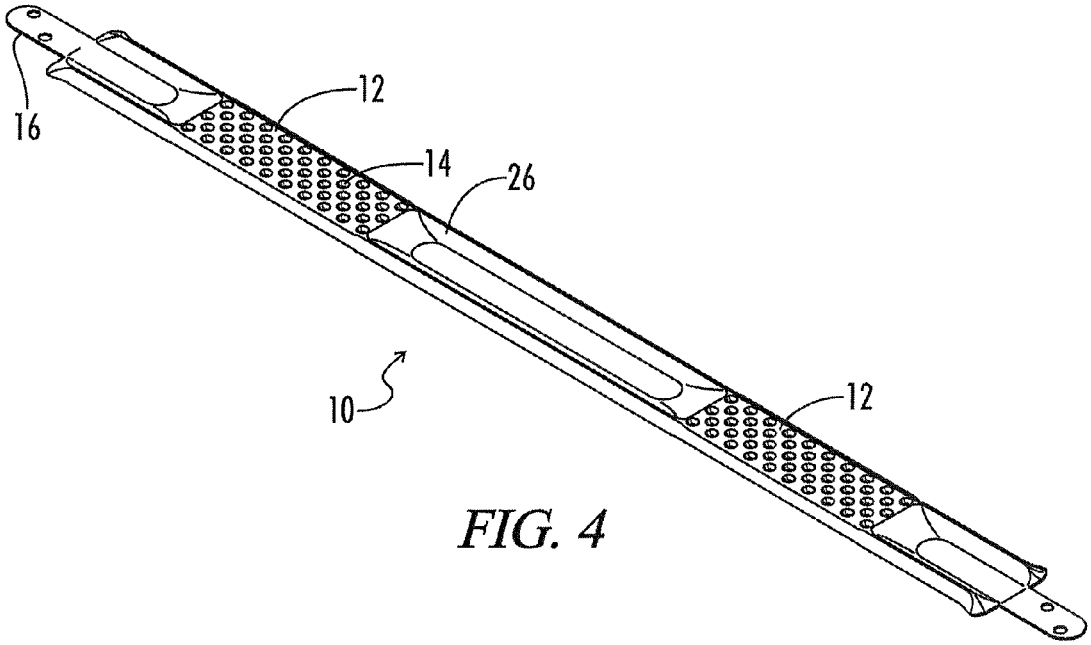
FIG. 4 is a perspective view of an optional embodiment of the dishwasher anchoring bracket.
Figure 5:
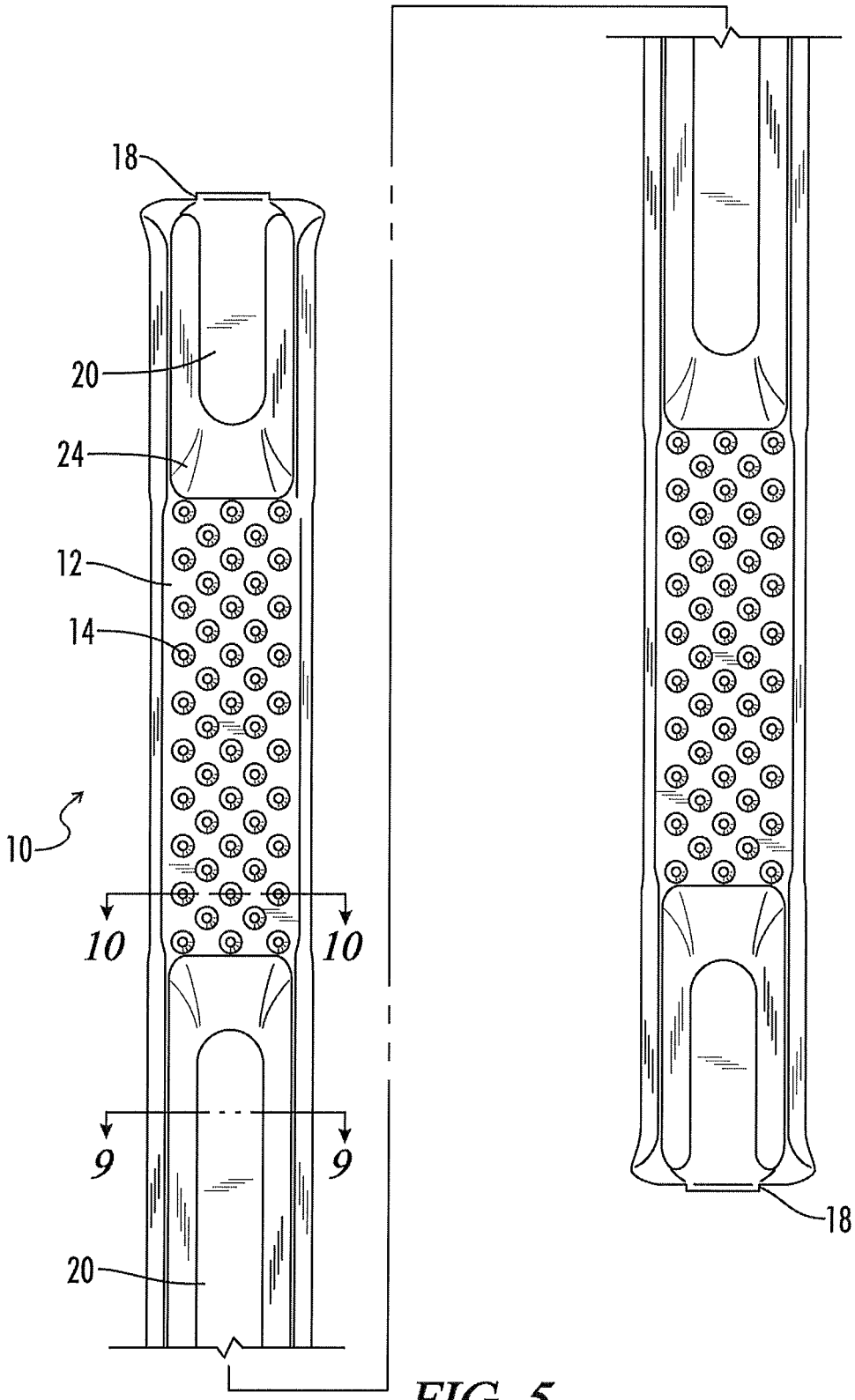
FIG. 5 is a top view of an optional embodiment of the dishwasher anchoring bracket with bent ends.
Figure 6:
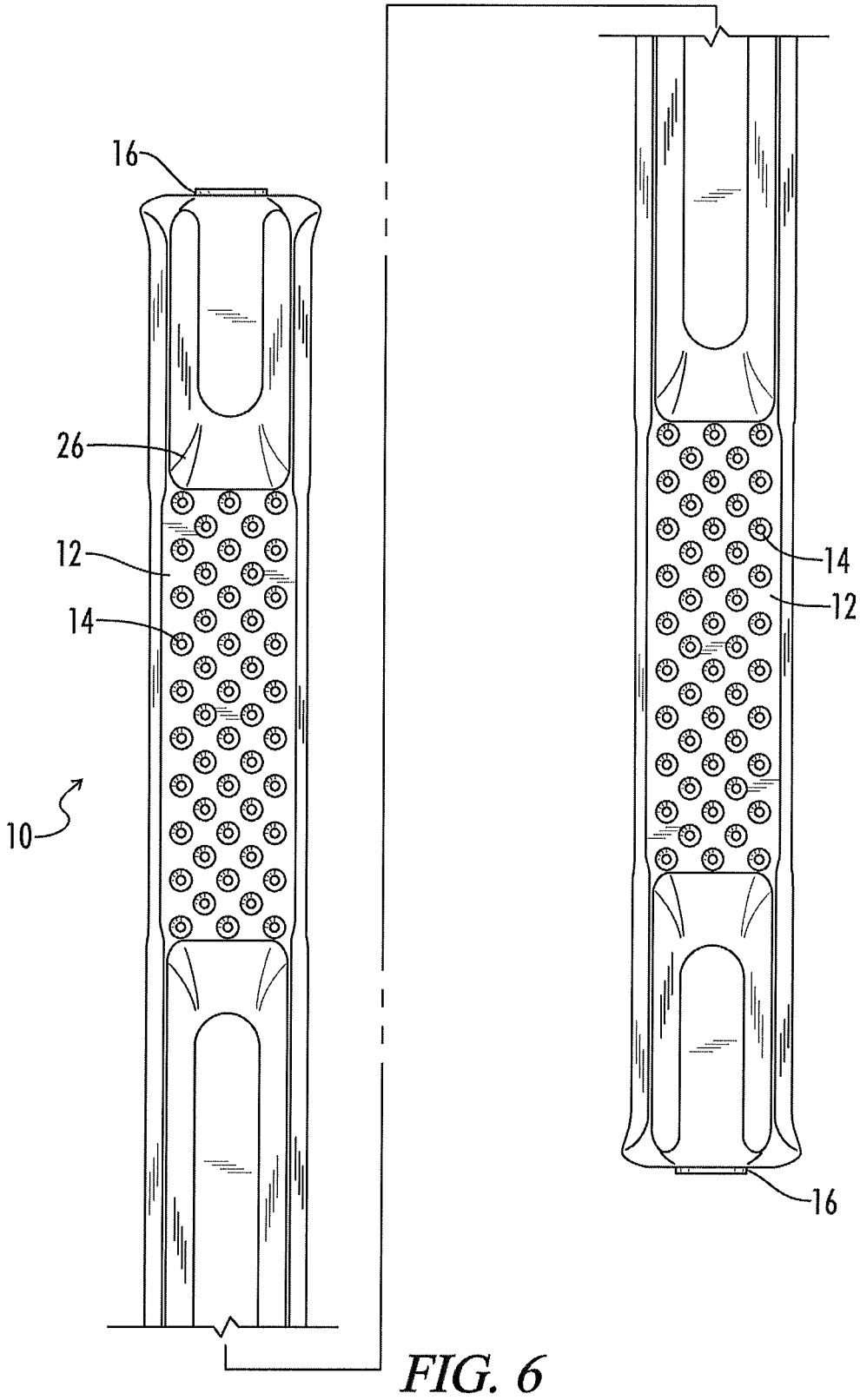
FIG. 6 is a bottom view of an optional embodiment of the dishwasher anchoring bracket with bent ends.
Figure 7:
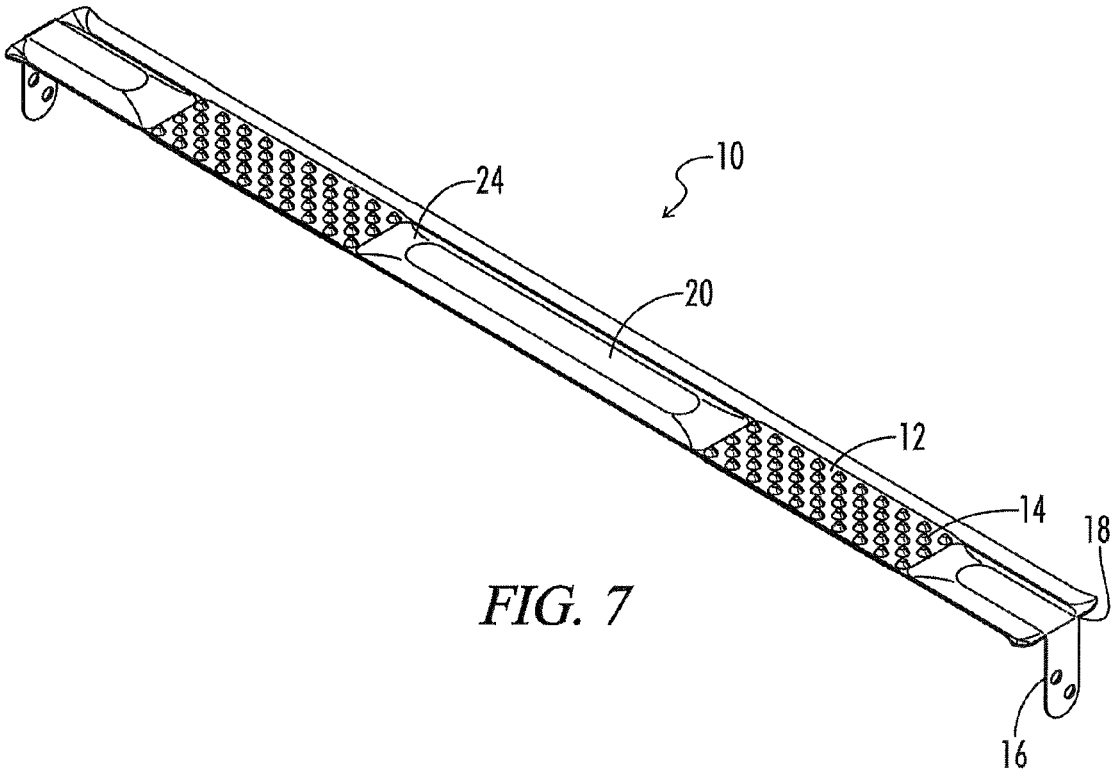
FIG. 7 is a perspective view of an optional embodiment of the dishwasher anchoring bracket with bent ends.
Figure 8:
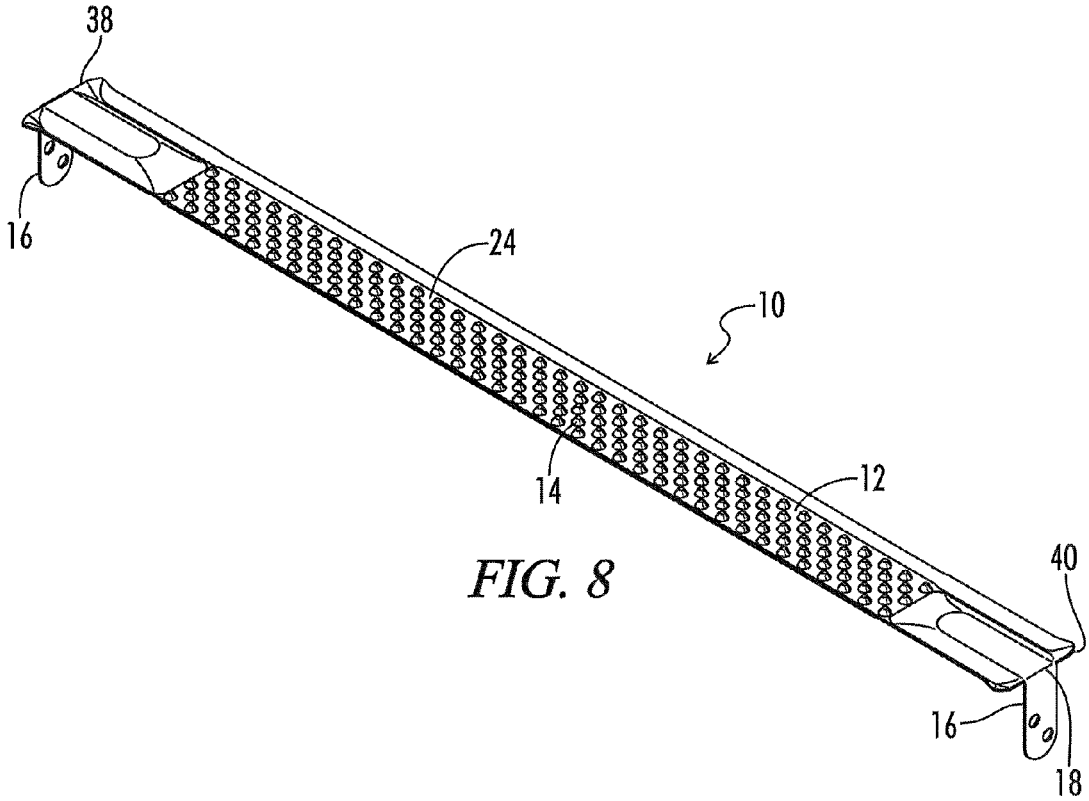
FIG. 8 is a view of an optional embodiment of the dishwasher anchoring bracket with one anchoring zone.

Dishwasher anchoring bracket 10 may also include structural attachment points 16 which may be used to attach dishwasher anchoring bracket 10 to a structure. Generally, structural attachment points may comprise one or more holes as well as slits or other openings which may be utilized to secure dishwasher anchoring bracket 10. Structural attachment points 16 are attached to the top edge of cabinets through the use of screws or nails or other similar type attaching elements. Structural attachment points 16 are located at each end of dishwasher anchoring bracket 10 and in optional embodiments may comprise flex location 18. In embodiments of dishwasher anchoring bracket 10 having flex location 18, the ends may be bent for various applications in installing dishwasher anchoring bracket 10. For example, in instances where a user desires to install dishwasher anchoring bracket 10 to the side of adjacent structures such as cabinets, flex location 18 may be bent and subsequently secured at attachment point 16 to the cabinet. FIGS. 4-6 illustrate optional embodiments of dishwasher anchoring bracket 10 having flexible locations 18 with structural attachment points 16 being bent about 90°. Such flexibility may be desirable for instances where a kitchen is restored and the countertop is maintained and the user does not desire to drill into the previously installed countertop. As such, both flex locations 18 may be bent about 90° so that dishwasher anchoring bracket 10 may be installed without drilling or grinding the above countertop. In further embodiments not illustrated, either one or both or none of the ends of dishwasher anchoring bracket 10 may have flex locations 18.

As used herein, "hole" is defined as any opening for use in mounting, attaching, or anchoring and thus may include a slit or have a non-circular shape or not be completely surrounded by material of dishwasher anchoring bracket 10. Optional embodiments of dishwasher anchoring bracket 10 may also include caulk area 20 for the placement of caulk thereon. Generally caulk may be utilized for additionally securing dishwasher anchoring bracket 10 and also for possible shock absorbing qualities as most dishwashers are opened and closed daily. Optional embodiments include caulk area 20 so that caulk 28 placed thereupon will be contacted by a countertop which may either be subsequently placed upon an installed dishwasher anchoring bracket 10 or where dishwasher anchoring bracket 10 is pressed up against a pre-installed countertop and secured. Optional embodiments may include one or more caulk areas 20 with the caulk areas 20 being positioned in various locations on dishwasher anchoring bracket 10. In further embodiments caulk area 20 may be absent from the invention disclosed herein.

Figure 9:
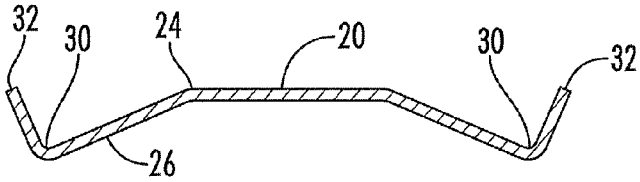
FIG. 9 is a close up view of a cross-section of the caulk area of an embodiment of the dishwasher anchoring bracket.

FIG. 9 illustrates a cross-sectional view of dishwasher anchoring bracket 10 where the caulk may be placed on top side 24 of caulk area 20. In optional embodiments, one or more recesses 30 may be included at one or more various locations on dishwasher anchoring bracket 10. Recesses 30 may be created through where the edges of dishwasher anchoring bracket 10 are slightly folded to create recesses 30. Furthermore edges 32 combined with recesses 30 may create a simplistic channel so that excess caulk will not be squeezed out of top surface 24 when dishwasher anchoring bracket 10 is installed. In further optional embodiments, caulk 28 may or may not be utilized and thus embodiments of the invention may include dishwasher anchoring bracket 10 with or without caulk as well as embodiments of dishwasher anchoring bracket 10 with or without caulk areas 20. Recesses 30 may also be absent.

Figure 10:
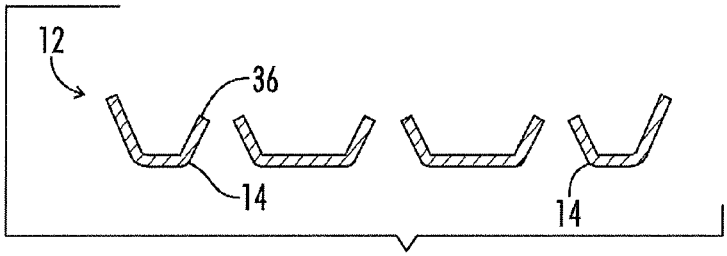
FIG. 10 is a view of a cross-section of anchoring holes of an embodiment of the dishwasher anchoring bracket.

Referring now to FIG. 10, there is a cross-sectional view through anchoring zone 12 having anchoring holes 14. In the optional embodiment illustrated in the figure, the anchoring holes 14 may comprise pierced edges 36. Generally pierced edges 36 provide for anchoring holes 14 and the securement of a screw therewithin without necessarily threading the anchoring holes. In further optional embodiments anchoring holes 14 may include internal threads or may optionally include no threads at all or may include a combination of threads, no threads and pierced edges in various optional embodiments for the invention.

Optional embodiments of dishwasher anchoring bracket 10 may include a length measured from end 38 to end 40 and in optional embodiments, may not including attachment points 16. As used herein, the dishwasher anchoring bracket length generally corresponds to the distance measured between the structural walls, between which the dishwasher is placed. For the U.S. market the dishwasher anchoring bracket length may be from about 32 to about 38 inches for the U.S. market. As foreign markets often utilize different dishwasher designs, the bracket may have a length from about 18 inches to about 38 inches so as to be useful for the smaller dishwasher designs. Further optional embodiments include a dishwasher anchoring length of from about 33 inches to about 35 inches. In yet further optional embodiments, the bracket may have a length of about 34 inches. The thickness of dishwasher anchoring bracket 10 is measured from the bottom surface 26 to top surface 24 and takes into account indentations as well as recesses and folded edges in calculating the thickness of the anchoring bracket. Generally, this value corresponds to the minimal amount of space needed between the countertop and the mounting hardware of the dishwasher for the anchoring bracket to fit. Optional embodiments of dishwasher anchoring bracket 10 include a thickness of less than about one inch with further optional embodiments having a thickness of less than about half an inch. Additional optional embodiments may include a thickness of about a half an inch. The width of the dishwasher anchoring bracket is generally of from about a half an inch to about 4 inches as well, though wider widths or narrow widths could be utilized in providing for larger or smaller anchoring zones. Optional embodiments may include an anchoring bracket having a width of about two inches.

An anchoring zones for the dishwasher anchoring bracket may span of from about one inches to about 34 inches and in optional embodiments may cover the majority of the surface of the dishwasher anchoring bracket or in further embodiments may be included in only smaller areas on the dishwasher anchoring bracket. In further optional embodiments, the dishwasher anchoring bracket may comprise two anchoring zones each having a length of from about two inches to about ten inches with each of the anchoring zones on different sides of a caulk area, the center caulk area having a length of from about two inches to about ten inches. In yet further optional embodiments, the dishwasher anchoring bracket may comprise a caulk area with an anchoring zone on each side, further with an additional caulk area on each side of the anchoring zones not next to the center caulk area.

Figure 11:
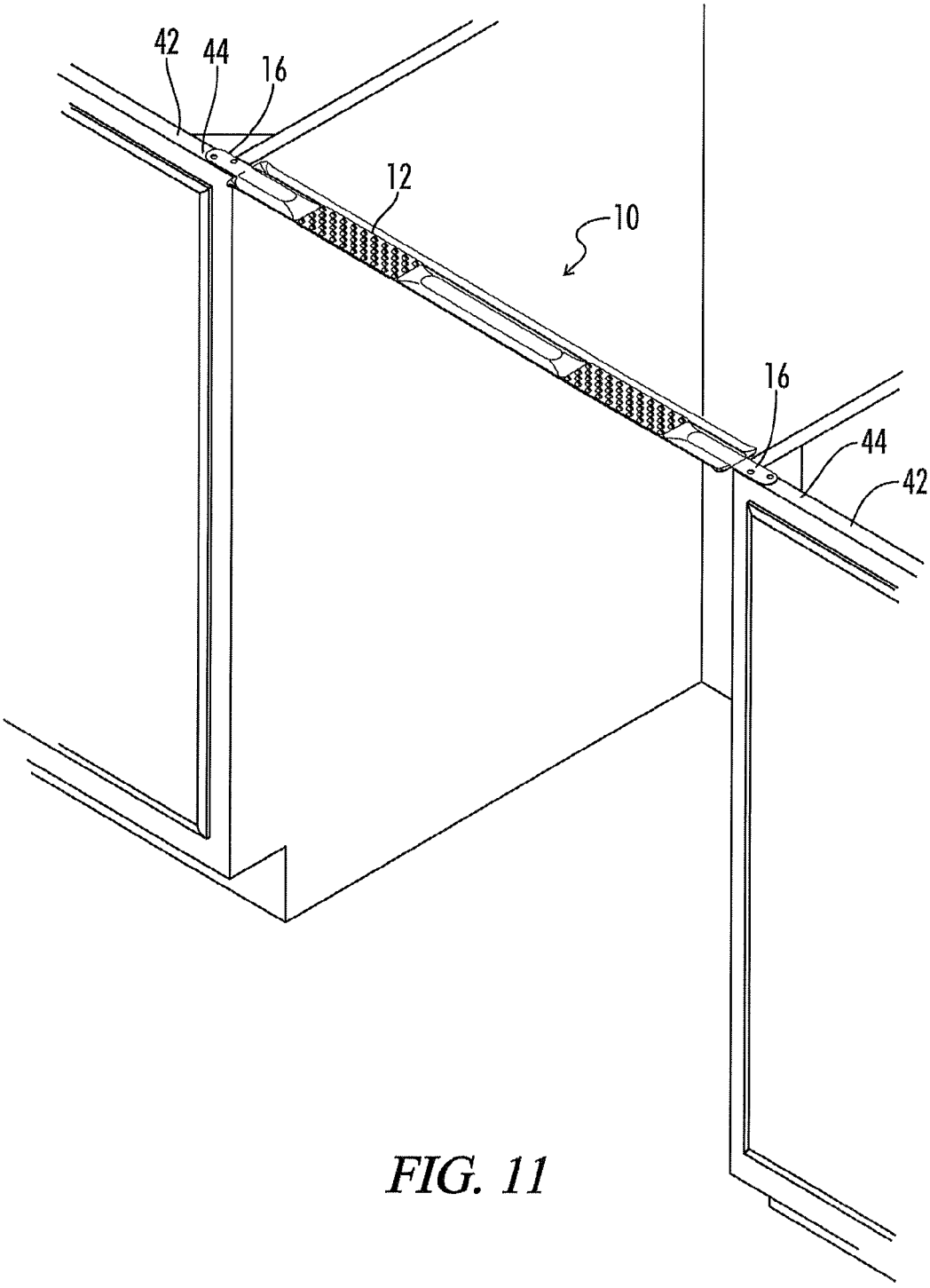
FIG. 11 is a view of an optional embodiment of the dishwasher anchoring bracket with adjacent cabinets.
Figure 12:
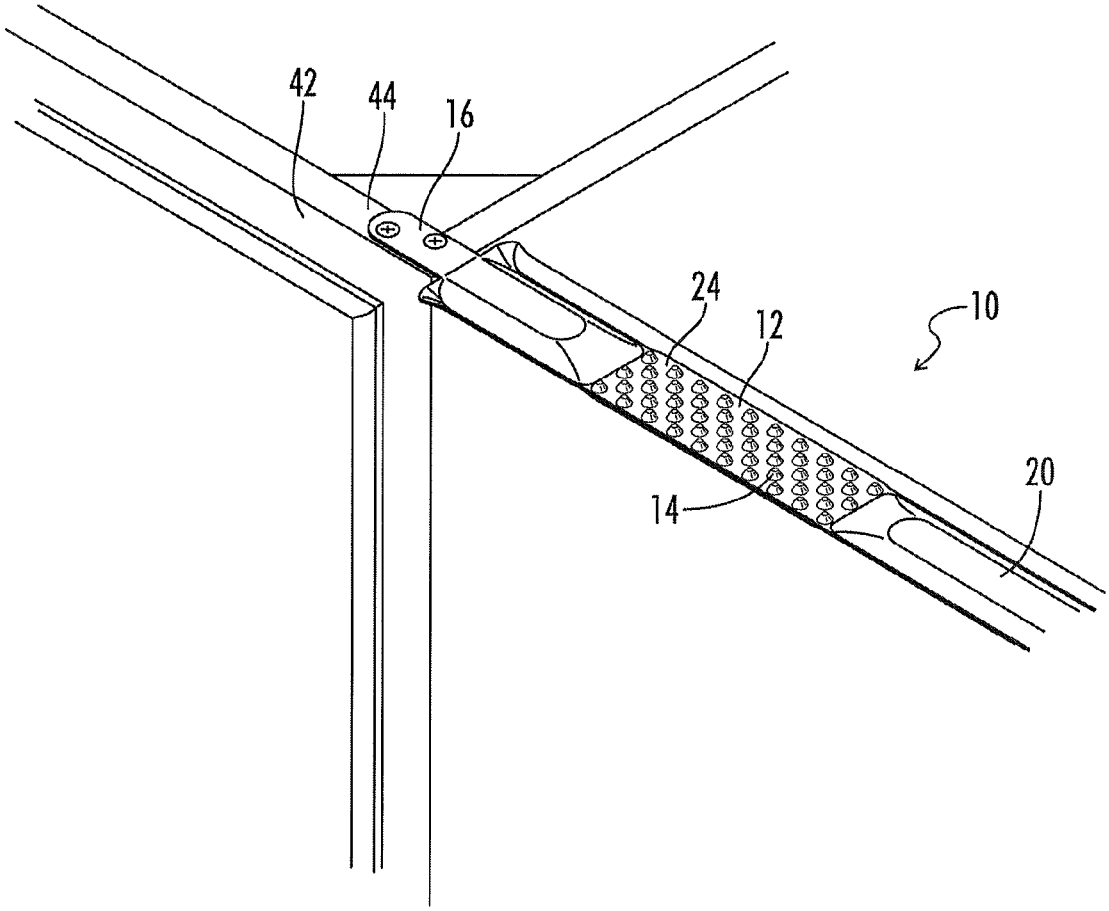
FIG. 12 is a view of an optional embodiment of the dishwasher anchoring bracket attached at the structural attachment point to a cabinet.

Referring now to FIG. 11 is an illustration of dishwasher anchoring bracket 10 with having attachment point 16 on adjacent structures 42. As provided in this illustration adjacent, structures 42 are cabinets which quite often are on each side of a dishwasher in a residential kitchen. Generally structures 42 comprise a solid structure being either a wall, cabinet or the like so that a user may attach dishwasher anchoring bracket 10 and the structural attachment points at both end 38 and 40 to structures 42. In this illustration bracket 10 is affixed through attachable point 16 via screws to edge 44 of adjacent structures 42. FIG. 12 provides a closer view of screws within structural attachment points that are used to secure dishwasher anchoring bracket 10 to adjacent structures 42 on edge 44.

Figure 13:
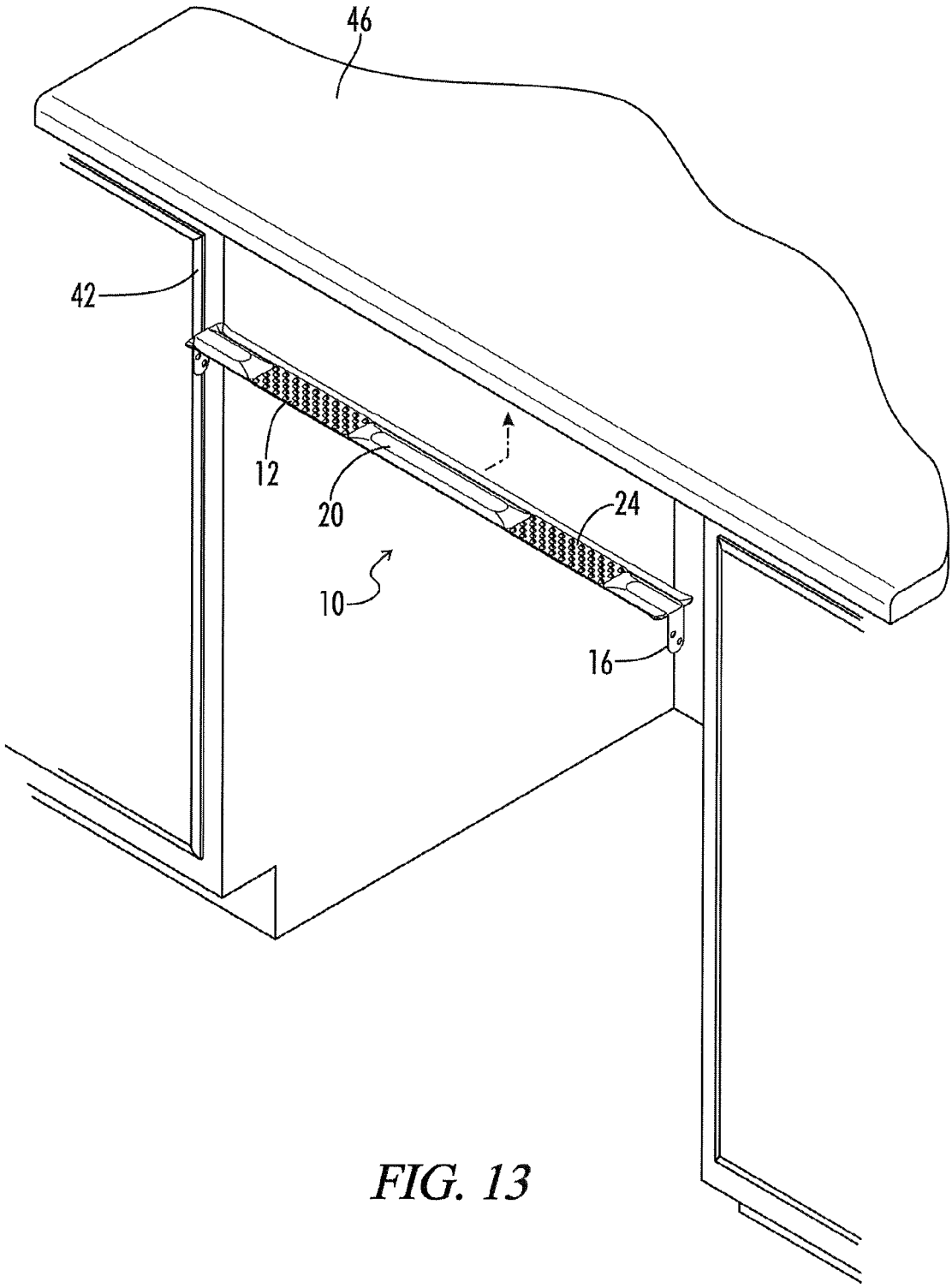
FIG. 13 is a view of an optional embodiment of the dishwasher anchoring bracket being positioned with bent flexible ends.
Figure 14:
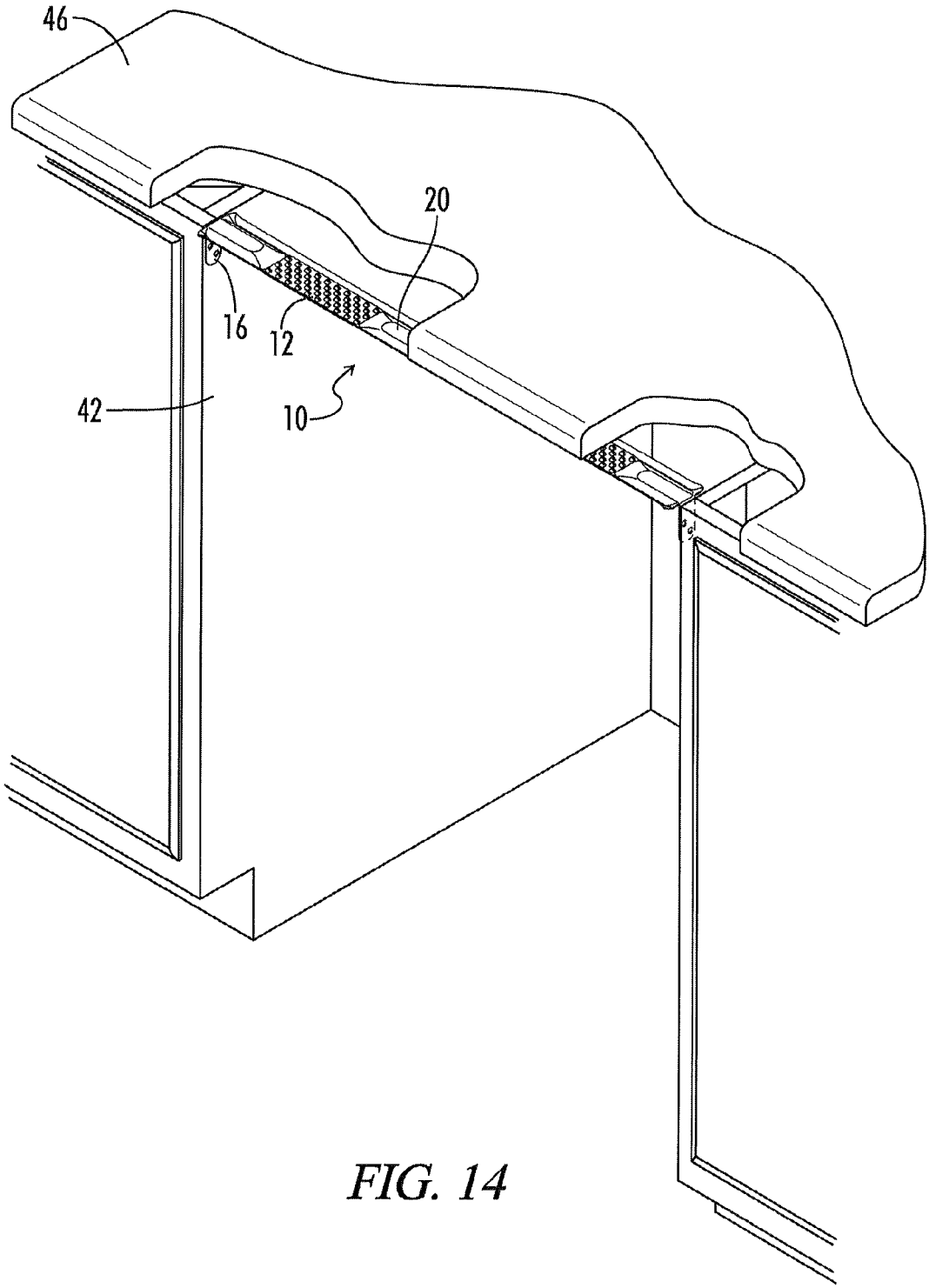
FIG. 14 is a view of an optional embodiment of the dishwasher anchoring bracket being positioned with bent flexible ends.

FIGS. 13 and 14 illustrate an optional embodiment of dishwasher anchoring bracket having structural attachment points bent at flex point 18 as countertop 46 is already in place. As such a user may secure dishwasher anchoring bracket 10 to side walls of adjacent structures 42 by bending structural attachment points at flex point 18 and attaching through structural attachment point 16.

Figure 15:
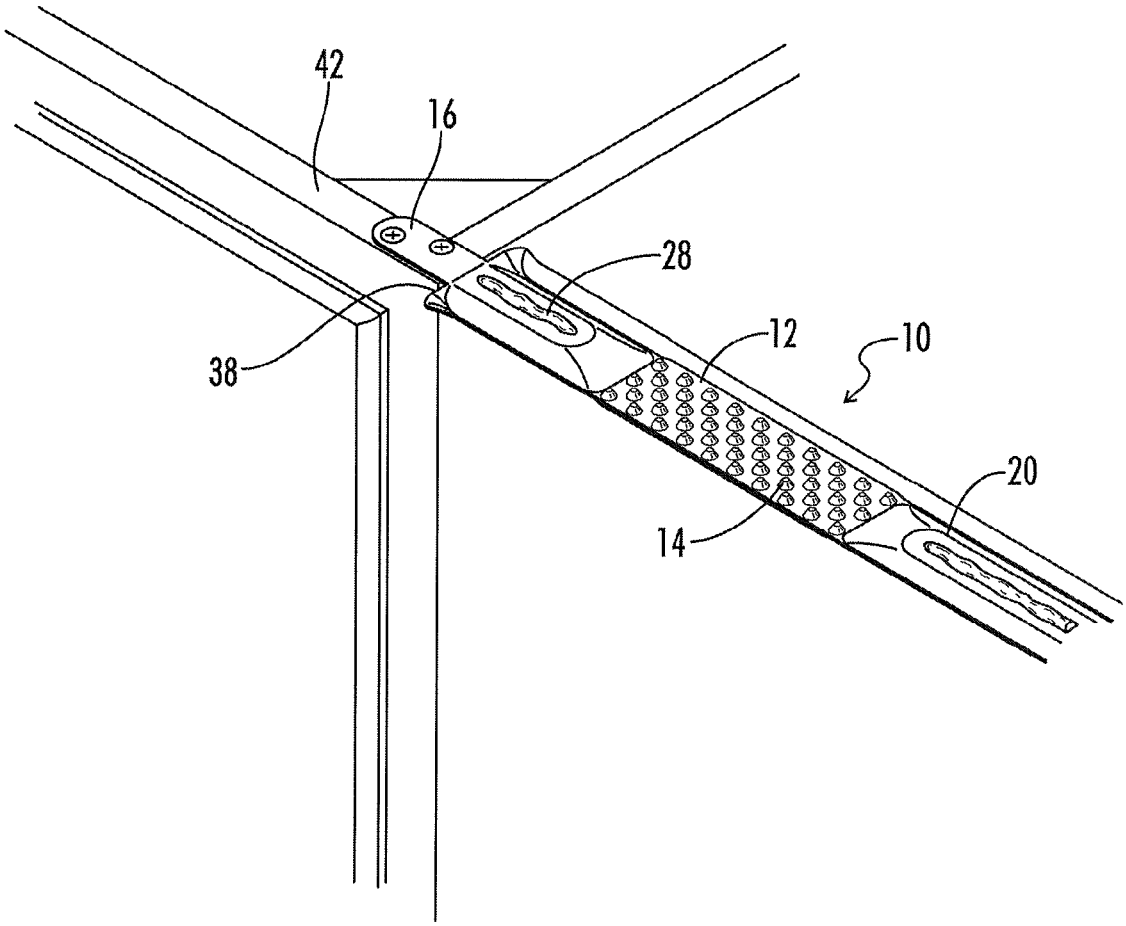
FIG. 15 is an illustration of an optional embodiment of the dishwasher anchoring bracket with caulk applied to the caulk areas.

FIG. 15 illustrates caulk being applied to caulk areas 20 of an optional embodiment of dishwasher anchoring bracket 10 for the subsequent installation of countertop 46 on top. For instances where countertop 46 may already be in place a user may apply caulk to caulk areas 20 prior to placing dishwasher anchoring bracket 10 into place under the countertops.

Figure 16:
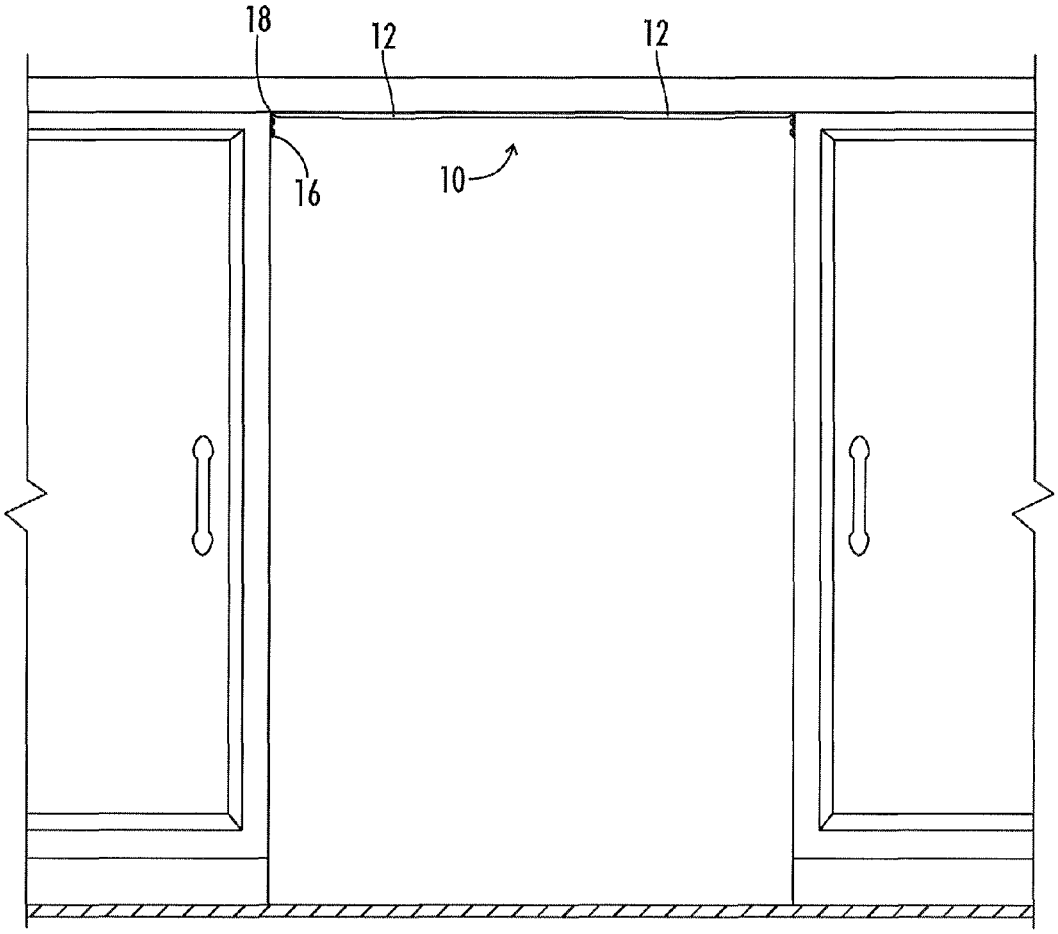
FIG. 16 is a view of an optional embodiment of the dishwasher anchoring bracket installed with a countertop in place.

FIG. 16 illustrates an optional embodiment of dishwasher anchoring bracket 10 in place with the structural attachment points secured on edge 44 of adjacent structures 42 with countertop 46 in place.

Figure 17:
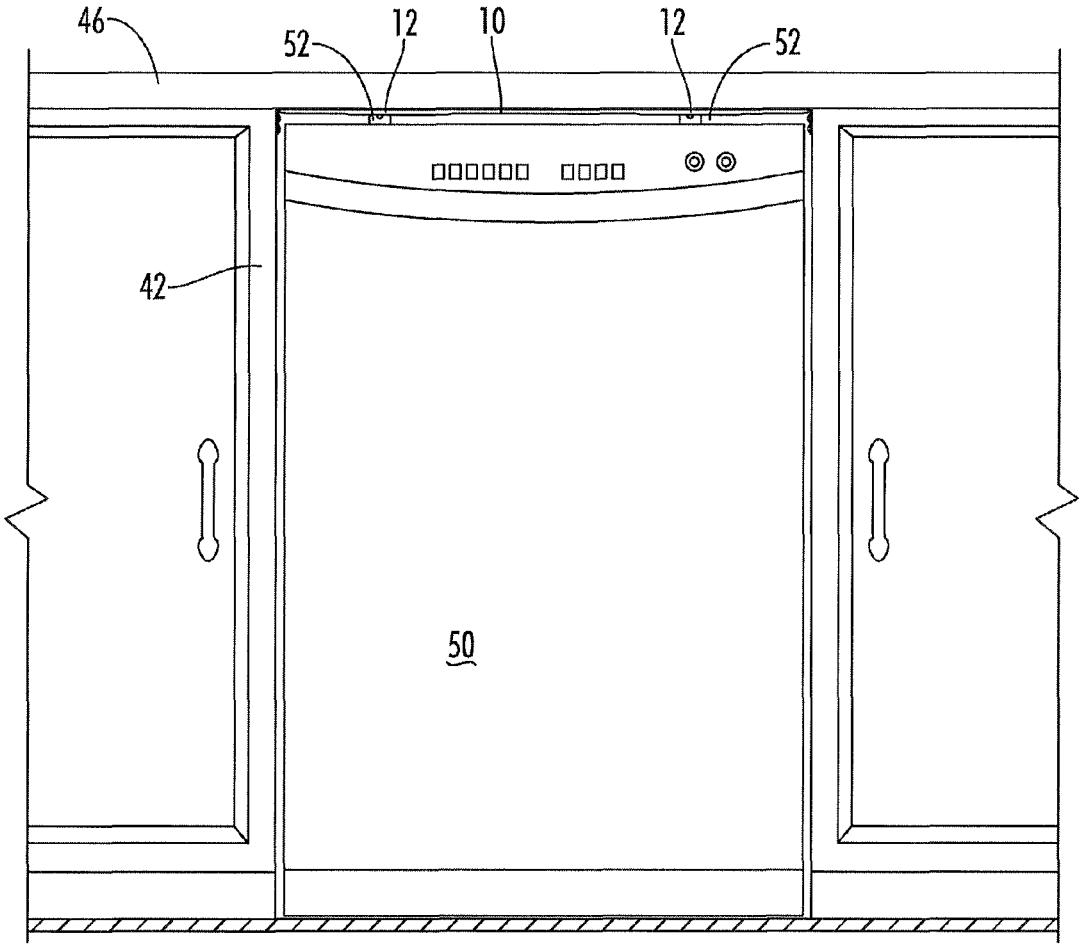
FIG. 17 is a view of an optional embodiment of the dishwasher anchoring bracket installed with a dishwasher secured to the anchoring bracket.

FIG. 17 is an illustration of anchoring bracket 10 in place with dishwasher 50 having hardware 52 being pushed in between the space between adjacent structures 42 and countertop 46. Generally dishwasher 50 will be inserted with dishwasher hardware 52 having a final position near or in contact with anchoring zone 12.

As illustrated in FIG. 17, dishwasher 50 may be put in place with dishwasher anchoring hardware 52 positioned near anchoring zone 12 to be subsequently secured to dishwasher anchoring bracket 10 through one of the anchoring holes 14. In further optional embodiments, dishwasher hardware 52 may comprise a variety of different shaped straps, clips, adjustments and designs.

The dishwasher anchoring bracket and method thereof according to the optional aspects of the invention may include any type of screw, nail, bolt or nut and the like that may be used so that dishwasher hardware 52 is connecting at anchoring zone 12 of dishwasher anchoring bracket 10. Generally optional embodiments of dishwasher anchoring bracket 10 may include one or more anchoring zones and may optionally include caulk areas. Additionally, the bracket may be symmetrical so as to simply installation.

Furthermore, sizes of various structural parts and materials used to make the above mentioned components are illustrative and exemplary only, and persons of ordinary skill in the art would recognize that these sizes and materials can be changed as necessary to produce different results or different desired characteristics.

It would become apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. An anchoring bracket for a dishwasher comprising:

a bracket body having a length, width and thickness, two ends, a top surface and a bottom surface, and anchoring zones;

the bracket body having a single, unitary body;

the anchoring zones for corresponding to the attachment of the dishwasher's anchoring hardware;

a plurality of anchoring holes within the anchoring zones for providing multiple options in anchoring the dishwasher, the plurality of anchoring holes spanning across both the width of each anchoring zone and across the length of each anchoring zone;

at least two structural attachment points with at least one structural attachment point located at each of the two ends;

at least one caulk area having a surface for caulk, the top surface of the at least one caulk area raised relative to the top surface of at least one of the anchoring zones;

the bracket body's length for corresponding to the distance between two cabinets;

the at least one caulk area positioned between the anchoring zones; and the bracket body having a thickness of less than one inch.

2. The anchoring bracket of claim 1 further comprising at least one flex point located on at least one end of the bracket.

3. The anchoring bracket of claim 2 further comprising two flex points, with at least one flex point located on each end of the bracket.

4. The anchoring bracket of claim 1 wherein the bracket has a length of from about 18 inches to about 38 inches.

5. The anchoring bracket of claim 4 wherein the bracket has a length of from about 33 inches to about 35 inches.

6. The anchoring bracket of claim 1 further comprising two anchoring zones.

7. The anchoring bracket of claim 1 wherein at least one anchoring zone is located on each end of the at least one caulk area.

8. The anchoring bracket of claim 1 wherein the anchoring bracket comprises three caulk areas.

9. The anchoring bracket of claim 1 wherein at least some of the anchoring holes comprise pierced holes.

10. The anchoring bracket of claim 1 wherein the thickness of the anchoring bracket is less than about a half an inch.

11. The anchoring bracket of claim 1 wherein the width of the anchoring bracket is from about a half an inch to about four inches.

12. The anchoring bracket of claim 1 wherein the bracket further comprises at least a partially folded edge.

13. The anchoring bracket of claim 1 wherein the bracket is symmetrical.

14. An anchoring bracket for a dishwasher comprising:

a bracket body having two ends, two anchoring zones each with a top surface and a bottom surface, and a caulk area with a top surface and a bottom surface, and bracket edges;

each anchoring zone for corresponding to the attachment of at least one dishwasher anchoring strap;

a plurality of anchoring holes within the each of the anchoring zone for providing multiple options in anchoring the dishwasher, the plurality of anchoring holes spanning across each anchoring zone's length and also each anchoring zone's width;

the caulk area located between the two anchoring zones;

the top surface of the anchoring zone below the top surface of the caulk area;

the bracket's edges about even with the surface of the at least one caulk area;

a structural attachment point at each end of the anchoring bracket;

each structural attachment point having alternate positions between about perpendicular with the length of the dishwasher bracket and about co-planar as the dishwasher bracket; and flex locations at each end of the bracket to provide for the alternate positions of the structural attachment points.

15. An anchoring bracket for a dishwasher comprising:

a bracket body having a length, width and thickness, two ends, a top surface and a bottom surface, and at least one anchoring zone;

the bracket body having a single, unitary body:

the at least one anchoring zone for corresponding to the attachment of a dishwasher's anchoring hardware;

a plurality of anchoring holes within the at least one anchoring zone for providing multiple options in anchoring the dishwasher, the plurality of anchoring holes spanning across both the width of each anchoring zone and across the length of each anchoring zone;

at least two structural attachment points with at least one structural attachment point located at each of the two ends;

at least one caulk area having a surface for caulk, the top surface of the at least one caulk area raised relative to the top surface of the at least one anchoring zone, the caulk area having a width of less than the width of the width of the bracket body;

the at least one caulk area positioned between the at least two anchoring zones; and the bracket body's length for corresponding to the distance between two cabinets; and the bracket body having a thickness of less than one inch.

16. An anchoring bracket for a dishwasher comprising:

a bracket body having a length, width and thickness, two ends, a top surface and a bottom surface, and at least two anchoring zone;

the bracket body having a single, unitary body;

the at least two anchoring zone for corresponding to the attachment of a dishwasher's anchoring hardware;

a plurality of anchoring holes within the at least two anchoring zone for providing multiple options in anchoring the dishwasher, the plurality of anchoring holes spanning across both the width of each anchoring zone and across the length of each anchoring zone;

at least two structural attachment points with at least one structural attachment point located at each of the two ends;

at least one caulk area having a surface for caulk, the top surface of the at least one caulk area raised relative to the top surface of the at least two anchoring zone, the caulk area having a width of less than the width of the width of the bracket body;

the bracket body's length for corresponding to the distance between two cabinets; and the bracket body having a thickness of less than one inch.

* * * * *